US005487243A

United States Patent [19]

Hale et al.

[11] Patent Number: 5,487,243

[45] Date of Patent: Jan. 30, 1996

[54] STORM SHUTTER SYSTEM

[75] Inventors: Joseph F. Hale, Dublin, Va.; Jeffrey Burgardt, Indianapolis, Ind.

[73] Assignee: Lin El, Inc., Mooresville, Ind.

[21] Appl. No.: 147,748

[22] Filed: Nov. 4, 1993

[51] Int. Cl.[6] ..... E06B 3/26

[52] U.S. Cl. ..... 52/202; 52/309.9; 49/464; 49/61; 292/145

[58] Field of Search ..... 52/202 OR, 203, 52/456, 808, 656.2, 656.5, 309.9; 49/463, 464, 61; 292/145

[56] References Cited

U.S. PATENT DOCUMENTS

| | | | |
|---|---|---|---|
| 1,165,670 | 12/1915 | Higgin et al. | 49/61 X |
| 1,574,222 | 2/1926 | Wensel | 292/145 |
| 1,626,482 | 4/1927 | Sargent | 292/145 |
| 2,568,195 | 9/1951 | Jones . | |
| 2,835,935 | 5/1958 | Housley . | |
| 3,340,650 | 9/1967 | Sackett, Sr. | 49/463 |
| 3,376,669 | 4/1968 | Johnston | 49/463 X |
| 3,381,416 | 5/1968 | De Torres et al. | 49/464 |
| 4,221,091 | 9/1980 | Ganse et al. | 52/202 |
| 4,384,436 | 5/1983 | Green . | |
| 4,606,161 | 8/1986 | Hosoe . | |
| 4,676,024 | 6/1987 | Rossman | 49/61 X |
| 4,726,149 | 2/1988 | Tryba . | |
| 4,968,171 | 11/1990 | Shell . | |
| 5,038,531 | 8/1991 | Olewska . | |
| 5,042,552 | 8/1991 | Prevatt . | |
| 5,097,643 | 3/1992 | Wittler . | |
| 5,216,861 | 6/1993 | Meyerson | 52/309.9 |
| 5,335,452 | 8/1994 | Taylor | 52/202 X |
| 5,347,775 | 9/1994 | Santos | 52/202 |

FOREIGN PATENT DOCUMENTS

| | | | |
|---|---|---|---|
| 464456 | 4/1950 | Canada | 52/202 |
| 10326 | 8/1956 | Germany | 52/202 |

*Primary Examiner*—Wynn E. Wood

*Attorney, Agent, or Firm*—Woodard, Emhardt, Naughton Moriarty & McNett

[57] ABSTRACT

Described is a preferred shutter system for protecting building interiors against severe weather conditions such as hurricanes. Advantageous shutter systems are stackable, comprising a plurality of panels, and are adapted for pressure fit within a window frame. Shutter systems of the invention also include cross bars engageable by the panels of the shutter system which provide support against both positive and negative pressures.

20 Claims, 7 Drawing Sheets

Fig. 1
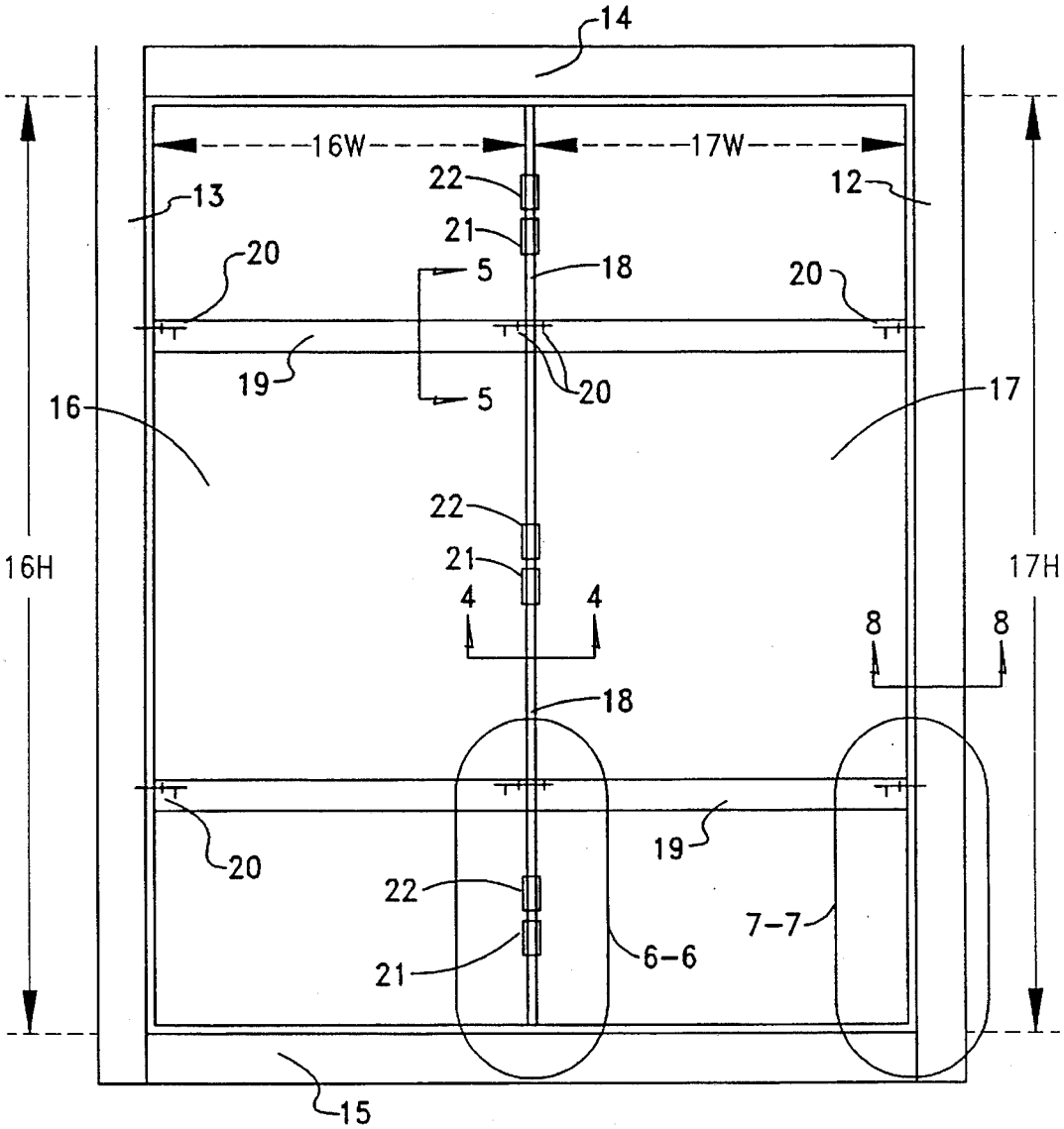
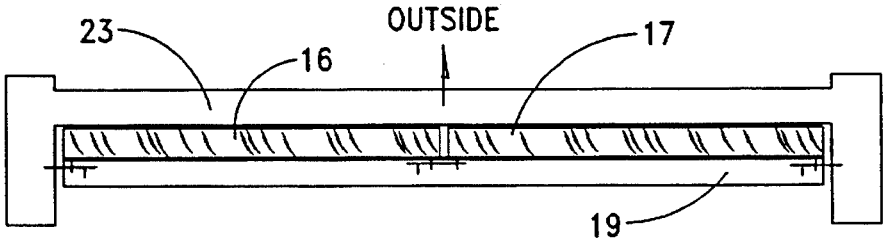
Fig. 2

STORM SHUTTER SYSTEM

BACKGROUND OF THE INVENTION

The present invention relates generally to devices for protecting building structures against extreme weather conditions. More particularly, the present invention relates to an interiorly-mounted shutter system effective to protect building interiors against extreme weather conditions such as hurricanes.

Severe weather conditions cause extensive damage to buildings and other structures yearly. To protect against such conditions, many storm shutter systems have been designed to protect against window damage caused by flying debris, which can lead interior damage caused both by debris and water driven into buildings.

Although in the past most resort has been made to simply boarding up window exteriors with plywood or the like, some more sophisticated systems have been proposed. For example, U.S. Pat. No. 2,568,195 to Jones describes a storm shutter for protecting windows or glazed openings which is adapted for prompt installation in the face of an impending storm. The Jones shutter system is exteriorly installed, and includes a fixed foot and header which are channeled so as to slidably receive a plurality of independent shutter slats. To install the shutter system, the shutter slats are positioned together in an overlapping relationship to form an awning. To remove the system, the slats are slid out of the channels and can be stored until their use is again necessitated.

U.S. Pat. No. 4,384,436to Green describes a combination hurricane shutter and security grill. The grill is mounted on the exterior of a window and includes variously shaped metallic bars to create an ornamental effect. L-shaped brackets are fastened to top and bottom latitudinal bars of the grill and provide channels to facilitate insertion of a shutter board which encloses the grill and associated window. The shutter board is fastened to the brackets with metallic wood screws to provide protection against severe weather conditions.

U.S. Pat. No. 4,726,149 to Tryba describes an installable exteriorly-mounted window protector to protect windows against flying debris in stormy conditions. The protector includes a rectangular sheet of plywood sized to the internal dimensions of the window to be protected. The plywood is provided with two handles in the lower section which are vertically aligned, which permit the plywood sheet to be manipulated during installation. The upper edge of the sheet is tapered to assist in guiding the engagement of the sheet is tapered to assist in guiding the engagement of the sheet with the top outside lip of the window frame. The protector is also provided with deadbolts on each vertical side, which cooperate with holes in the exterior window frame to secure the protector in place. To install the protector, the user, located inside the building structure, opens the window to be protected. The sheet is then manipulated to the exterior of the window using the aligned handles and caused to engage with the top lip of the window. The handles are then used to pull the sheet against the window frame, and the deadbolts are extended into cooperating holes to secure the protector.

U.S. Pat. No. 2,835,925 to Housley describes a hurricane shield which is positioned exterior of a protected window or door opening. The shield includes a head rail and a sill rail fixed at locations above and below the outside of the opening, respectively. A plurality of shield units are bolted to the head and sill rails, each unit including bars or braces to which are attached metal plates in a spaced relation so as to leave narrow gaps between the plates. The gaps allow the passage of light and air into the building. At the same time, alternating grooves and ridges in the metal plates create wind currents which discourage the passage of water through the gaps so as to enter the building.

U.S. Pat. No. 5,042,552to Prevatt describes a locking system for vertical shutters to protect against break-ins. The locking system is built into the frame housing the shutters. Fixed top and bottom horizontal members obstruct one side of the shutters. Top and bottom horizontal sliding members are concealed within the shutter frame and are manually operable to obstruct the interior face of the shutter. The top and bottom horizontal members are designed to bear pressure by a would-be intruder trying to push or pull the shutters. A locking pin inserted through the side of the shutter frame and into a sliding side member obstructs movement of the top and bottom horizontal sliding members to prevent intruders from jimmying the shutters open.

In light of the background in the area of storm shutter systems, there exists a continued need for improved systems which are easy to install and remove. Improved systems should also minimize alterations to the appearance or function of existing windows, and should be readily stored when not in use. Further, improved shutter systems should be easy to install in a brief period of time,and provide maximal protection against damage cause to building interiors by both flying debris and driven water. The present invention addresses these and other needs in the field.

SUMMARY OF THE INVENTION

One object of the invention is to provide a storm shutter system which minimize alterations to the appearance or function of existing windows.

Another object of the invention is to provide a storm shutter system which is lightweight, conveniently stackable and readily stored when not in use.

Another object of the invention is to provide a storm shutter system which provides protection against both negative and positive pressures.

Another object of the invention is to provide a storm shutter system which provides superior protection against water damage in the event of window breakage.

Another object of the invention is to provide a storm shutter system that combines the features of light weight and sturdy construction.

Still another object of the invention is to provide a storm shutter system that can be quickly installed without the need for special tools or apparatuses.

These and other objects of the invention are achieved by preferred embodiments of the invention, one of which provides a storm shutter system which includes a window mounted within a window frame and separating a building exterior from a building interior. A plurality of shutter panels are positioned substantially flush against and covering the interior surface of said window, the panels having perimeter edges and compressible members such as gaskets attached thereabout. Further, the panels, taken together, are slightly oversized relative to said window frame so that when said panels are positioned flush against said window, the compressible gaskets are compressed against said window frame to create a seal. The system also includes one or more cross bar members mounted interiorly of said panels so as to support said panels against at least positive pressure. In a more preferred embodiment, the cross bar members are engaged by members on the shutter panels to provide support against both positive and negative pressure.

Another preferred embodiment of the invention provides a shutter panel for a storm shutter system. The shutter panel includes an inner core member having first and second faces and perimeter edges. The first face of the core member is for positioning against the window to be protected, and the second face is adapted to engage a cross bar. A relatively thin metal sheet covers at least the first face and preferably both the first and second faces. Compressible members such as gaskets are attached about the perimeter edges of the core member. Cross bar-engaging members are movably attached to the panel and located on the second face, the cross-bar engaging members being adapted to engage across bar for supporting the panel. Further, the cross bar-engaging members are positionable to a first position substantially flush against or interior of the second face of the panel, and positionable to a second position extending outwardly from the second face for engaging said cross bar.

Another preferred embodiment of the invention provides a storm shutter for installation in the interior frame of a door or window opening. The storm shutter includes a plurality of shutter panels adapted to cover the opening and having perimeter edges and compressible members attached about the perimeter edges. Taken together, the panels are slightly oversized relative to the frame, so that when the panels are positioned in the frame to cover the opening, the compressible gaskets are compressed against the frame to create a seal.

Additional preferred embodiments, objects and advantages of the invention will be apparent from the following description.

BRIEF DESCRIPTION OF THE DRAWINGS

FIG. 1 provides a plan view of a shutter system in accordance with the invention.

FIG. 2 provides an elevational view of the shutter system of FIG. 1.

DESCRIPTION OF THE PREFERRED EMBODIMENT

Figure 3:
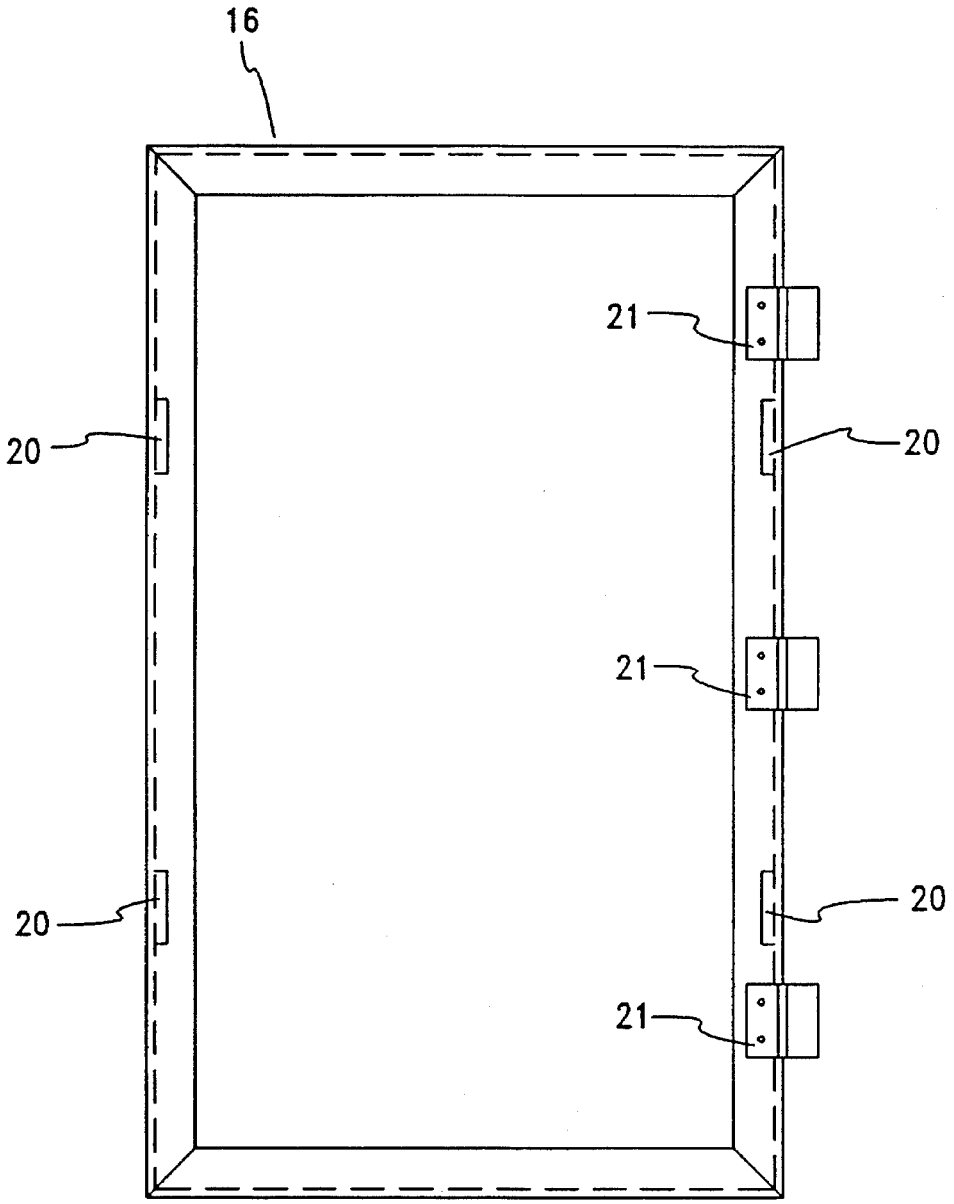
FIG. 3 provides a plan view of the left panel of the shutter system of FIG. 1.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device,and such further applications of the principles of the invention as illustrated therein being contemplated as would normally occur to one skilled in the art to which the invention relates.

As indicated above, one aspect of the present invention relates to a shutter system for protecting building interiors against extreme weather. Referring now to FIGS. 1 and 2, shown are plan and elevational views, respectively, of a shutter system 11 of the invention in place in the interior of a building window, such as that occurring in a high-rise building. The building window has mullions 12 and 13, a head member 14 and a sill member 15, which together form a window frame and which are typically formed from aluminum or a similar metal. Mounted within the window frame and against window glass (23, FIG. 2) are shutter panels 16 and 17 which function as impact and weather barriers in the shutter system of the invention. Panels 16 and 17, together, are generally sized to the interior dimensions of the window frame. Thus, a shown, panel 16 has a width 16W and panel 17 a width 17W, the sum of which is equal to or slightly greater than the width of the window frame. In this regard,it is preferred that the sum of 16W and 17W be slightly greater than the width of the window frame so as to cause a pressure fit and compression of gasket members against mullions 12 and 13in the installed shutter system as discussed further hereinbelow. In a similar fashion, panels 16and 17have respective heights 16H and 17H which are about equal to or slightly greater than the height of the window frame, so as to again facilitate a pressure fit and cause the compression of gaskets against head and sill members 14 and 15 by the assembled shutter system as also discussed below. Panels 16 and 17 abut against one another at central locations, creating a central joint as designated by numeral 18 in FIG. 1, and pressure is similarly applied at the central joint in the installed shutter system to compress gaskets there located.

Shutter system 11 further includes cross bar members 19 form from extruded metal such as aluminum which extend across the width of and engage the window frame, for example by deadbolts which extend into corresponding apertures in the window frame. Cross bars 19 also engage the panels 16 and 17 at a plurality of locations by deadbolts which cooperate with apertured tab plates 20 secured to panels 16 and 17. As illustrated, tab plates 20 are located at positions both near mullions 12 and 13 of the window frame and near the central joint. This engagement between the panels 16 and 17and the cross bars 19 will be discussed further hereinbelow.

Panel 16 includes a plurality of guide plates 21 and panel 17 includes a plurality of guide plates 22. Guide plates 21 and 22 preferably metal and are attached to their respective panels along the edges of panels 16 and 17 which form the central joint in the installed shutter system 11. Guide plates 21 and 22 assist in guiding and positioned panels 16 and 17 during the installation of shutter system 11 as discussed in greater detail below.

Referring now to FIG. 3, shown is a plan view of left panel 16 of the shutter system 11 shown in FIG. 1. As shown, panel 16 includes guide plates 21 attached along its vertical edge which abuts right panel 17 of the assembled shutter system to form the central joint. This attachment can be achieved, for example, by screw, bolt or other satisfactory means. Preferably, guide plates 21 will be attached so as to be substantially coplanar with the face of panel 16 to facilitate stackability of the panels during storage. Panel 16 also includes tab plates 20 in horizontally-aligned positions which are adapted to engage cross bar 19 (FIG. 1). Preferred panel 16 also has mitered edges, as shown. It will be understood that right panel 17 is constructed identically to panel 16, except in reverse orientation.

Figure 4:
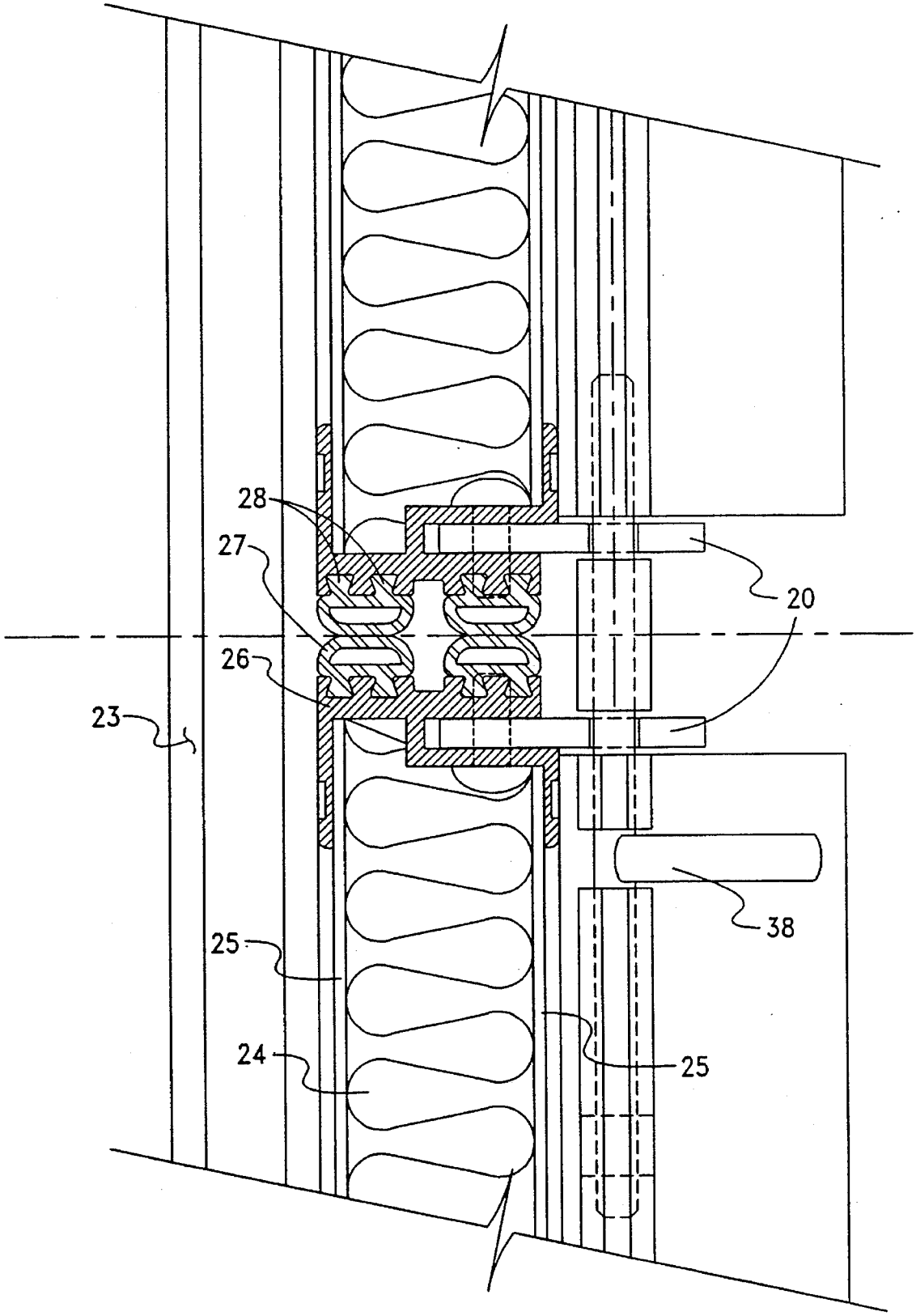
FIG. 4 provides a cross-sectional view taken along line 4—4 in FIG. 1 and viewed in the direction of the arrows.

Referring now to FIG. 4, which is a cross-sectional view taken along line 4—4 of FIG.1 and viewed in the direction of the arrows, shown is the central joint created by abutting panels 16 and 17 in the shutter system 11 installed interiorly of window 23 which is, for instance, made from a multi-layer insulated building glass. Panels 16 and 17 include a core 24 preferably constructed of a light-weight material such as an expanded plastic or a honeycomb plastic core, e.g. expanded polystyrene or acrylic or a honeycomb core formed from polypropylene and known as NORCORE PLASTIC HONEYCOMB, commercially available from Norfield Corportion, Danbury Conn. Core 24 has inner and outer faces covered with a thin layer of protective sheet metal 25. Sheet metal 25 can be,for example,an extruded aluminum material and is preferably relatively thin as compared to core 24, for example having a thickness of about 0.1 inch or less, e.g. about 0.004 inches in a preferred system. Sheet metal 25 can be affixed to the outer faces of core 24 in any suitable manner such as by bonding, rivets, screws, bolts, etc. Further, a more pliable layer, e.g. plastic or rubber, can be affixed to the outside of the sheet metal 25, especially on the panel side facing the window.

Surrounding the perimeters of panels 16 and 17 are extruded panel frame members 26 which are affixed to the core 24 and/or sheet members 25 by any suitable means such as bonding, rivets, screws, bolts, etc. Panels 16 and 17 further include gaskets 27 which extend entirely about their perimeters, and are engaged by panel frame members 26. This engagement can be achieved, for example, by providing nibs 28 on gaskets 27 which are engaged by corresponding recesses in frame members 26 as illustrated. Gaskets 27 are of course constructed of a suitable compressible material such as rubber or plastic, which facilitates the formation of water tight seals when compressed against another surface. For example, gaskets 27 may be EPDM gaskets as are currently available in commerce.

Figure 5:
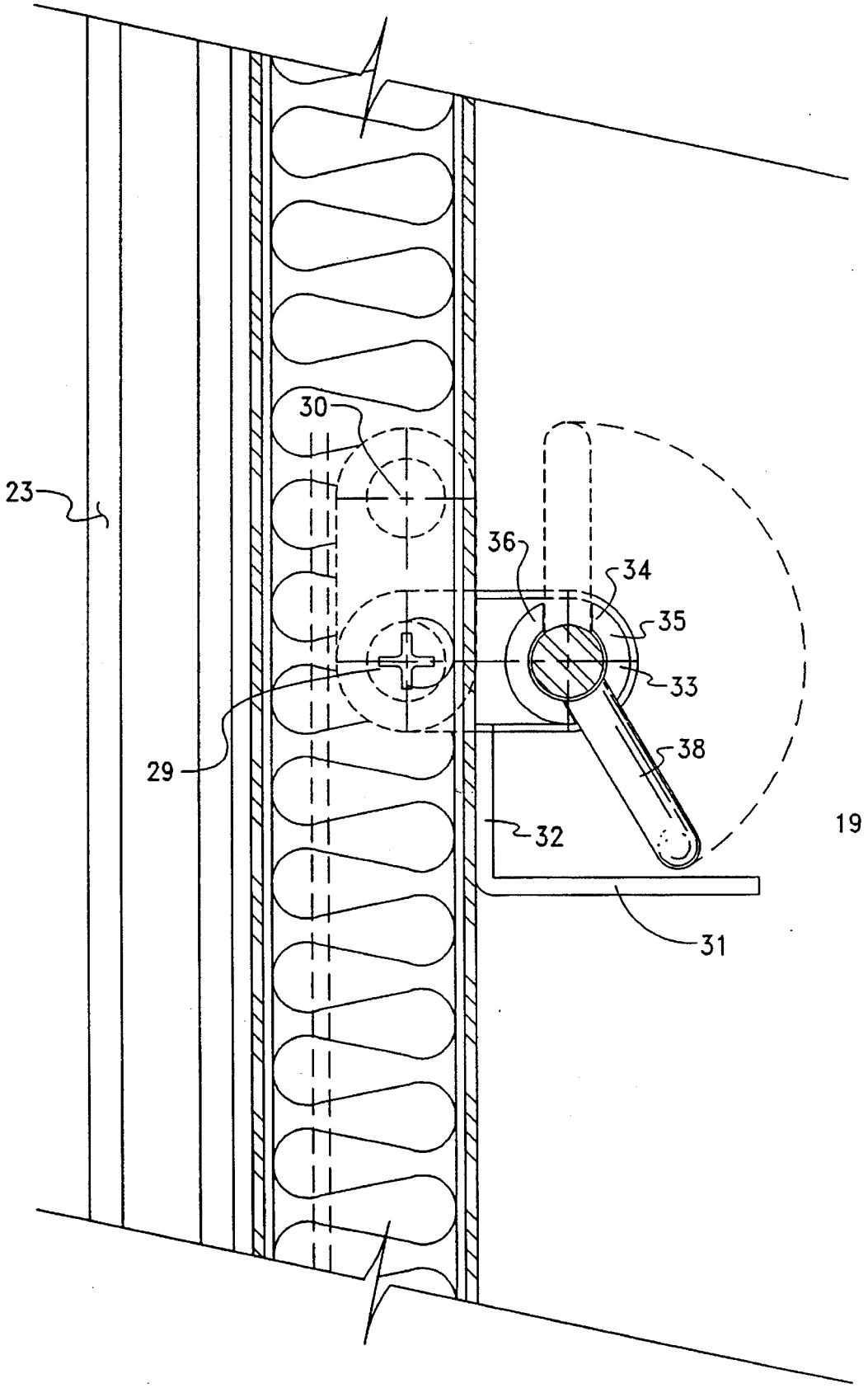
FIG. 5 provides a cross-sectional view taken along line 5—5 of FIG. 1 and viewed in the direction of the arrows.

Referring now to FIGS. 4 and 5 together, panels 16 and 17 include tab plates 20 adapted to engage cross bars 19 of the shutter system 11 of the invention. Tab plates 20 are rotateably mounted to panels 16 and 17 such that tab plates 20 can be positioned to extend horizontally from panels 16 and 17 (as illustrated in FIGS. 4 and 5) to engage cross bar 19 or vertically (shown i phantom in FIG. 5) so that their outermost edges are substantially flush or are otherwise received within the outermost surfaces of panels 16 and 17. To accomplish this, tab plates 20 can be attached at an inner area 29 of panels 16 and 17 in a rotatable fashion. Such attachment can be achieved by any suitable means such as a bolt,screw, rivet, etc. Tab plates 20 each define an aperture 30 which cooperates with a deadbolt pin to engage cross bars 19 as discussed below.

Figure 6:
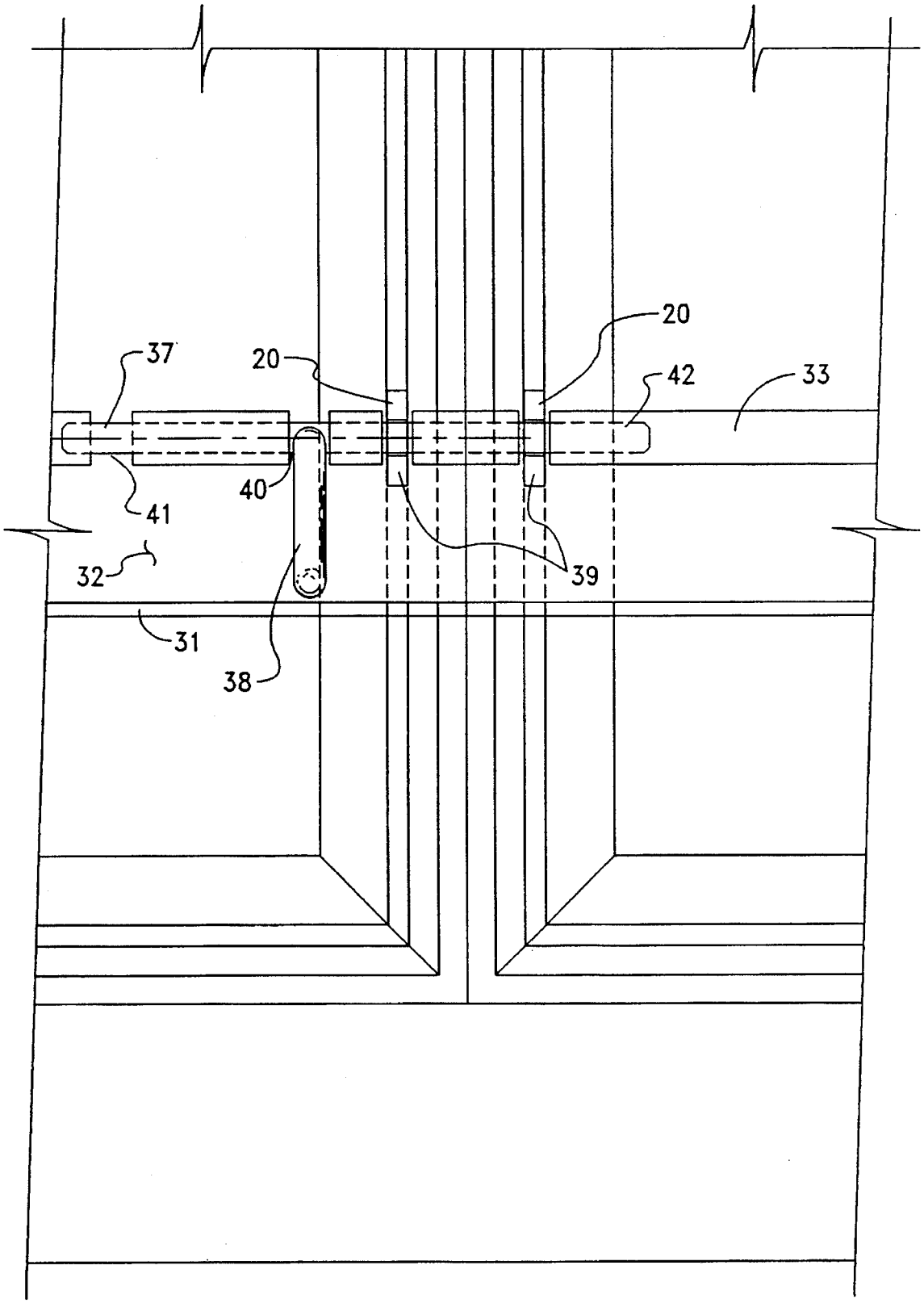
FIG. 6 provides an enlarged perspective view of areas within oval 6—6 of FIG. 1 (plates 21 and 22 not shown).

With continued reference to FIG. 5 and to FIG. 6, cross bars 19 of shutter system 11 are engaged by panels 16 and 17. Cross bars 19 include a horizontal arm 31 and a vertical arm 35, the latter of which when installed resides substantially flush against the inner faces of panels 16 and 17. Horizontal arm 31 of cross bar 19 is attached to a generally tubular cross bar portion 33 which has a slot 34 preferably at or near its upper portions. Thus, tubular portion 33 extends from first location 35 around to and terminating at second location 36, leaving slot 34. Deadbolt pin 37, having an outer diameter smaller than the inner diameter of tubular member 33, is slidably received within tubular member 33. Pin 37 includes arm 38 having an outer diameter less than the width of slot 34 in tubular member 33. Further, tubular member 33 is notched at locations 39 corresponding to tab plates 20 on panels 16 and 17. Notches 39 extend not only through tubular member 36 but also down into vertical arm 32 of cross bar 19. Notches 39 then support and act as a stop for tab plates 20 when they are rotated to their horizontally-extending position.

Tubular member 33 is further notched at locations 40 and 41 which alternately receive arm 38 of deadbolt pin 37 and correspond to engaged and disengaged positions, respectively. In this manner, arm 38 of pin 37 can be rotated to a vertical position and urged manually horizontally to slide pin 37 within tubular member 33. To create an engaged relationship between cross bar 19 and panels 16 and 17, pin 37 is positioned as in FIG. 6 with arm 38 positioned corresponding to and rotated down into notch 40, thus extending pin 37 through apertures 31 of tab plates 20 such that end 42 of pin 37 is received in portions of tubular member 33 beyond tab plates 20. In this fashion, tab plates 20 of panels 16 and 17 are engaged by pin 37, and thus cross bar 19 is engaged by panels 16 and 17. Cross bar 19 thereby provides resistance against both positive and negative forces (i.e. forces into and out of the building, respectively) that are applied to panels 16 and 17.

To disengage the panels 16 and 17 and cross bar 19, arm 38 of pin 37 is again vertically positioned to align it with slot 34, and moved horizontally (to the left in FIG. 6) until arm 38 corresponds in location to notch 41. Arm 38 can then be rotated downwardly into notch 41 and thus lock pin 37 out of engagement with panels 16 and 17. Appropriate stops may be incorporated in the deadbolt arrangements if desired, to prevent escape of pin 37 from tubular member 33.

Figure 7:
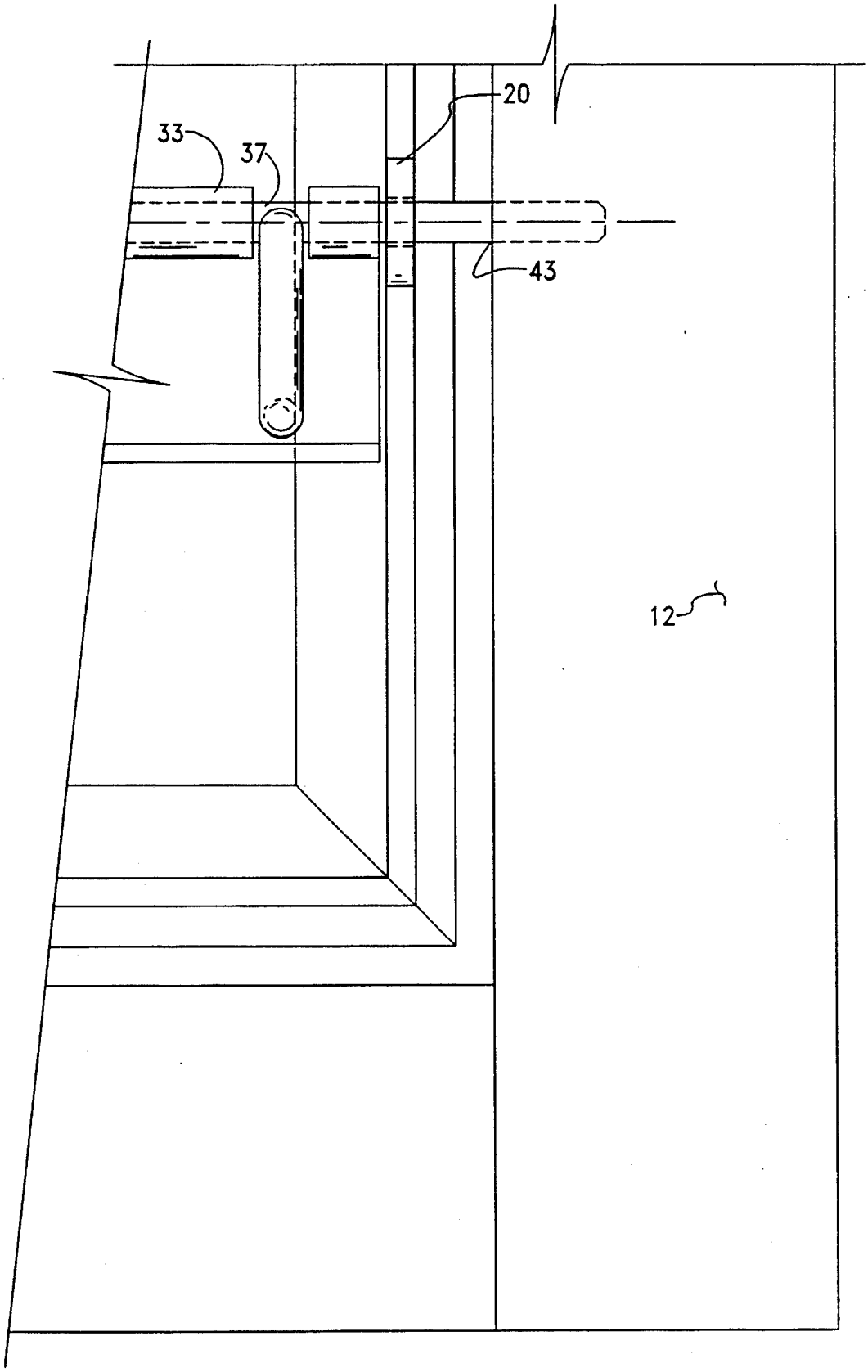
FIG. 7 provides an enlarged perspective view of areas within oval 7—7 of FIG. 1.
Figure 8:
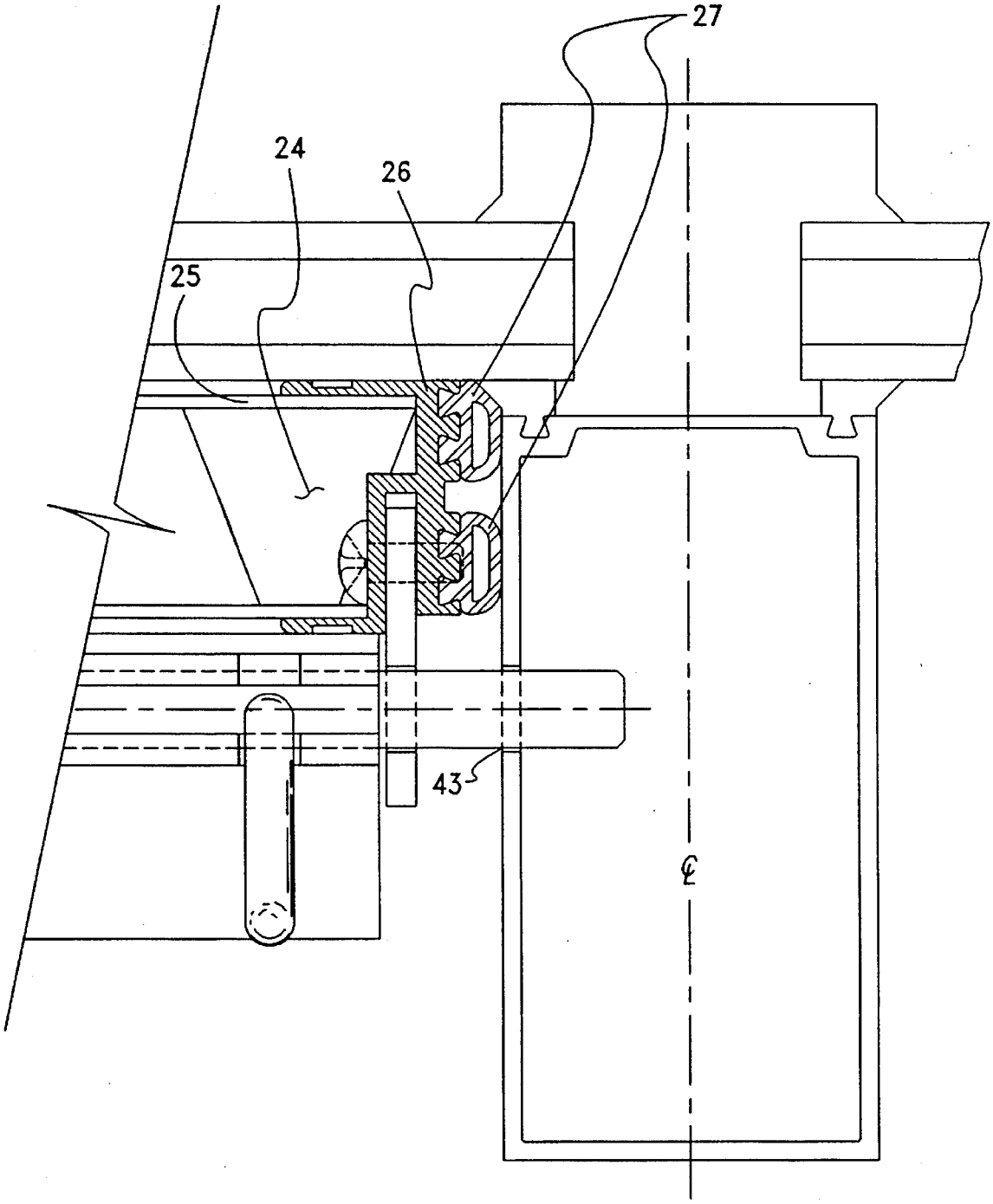
FIG. 8 is a cross sectional view of the shutter system of FIG. 1 taken along line 8—8 and viewed in the direction of the arrows.

Referring now to FIGS. 7 and 8, shown are a plan view of areas within oval 7—7 of FIG. 1 and across-sectional view taken along line 8—8 of FIG. 1 and viewed in direction of the arrows. These views illustrate the engagement of panels 16 and 17 and cross bars 19 with mullions of the window frame. As can be seen in FIG. 7, the outer edge of panel 17 is also provided with a rotateably mounted tab plate 20 similar in construction to previously described tab plates 20, and the outermost end of cross bar 19 is also notched and provided with a deadbolt pin 37 in a fashion similar to that previously described. Pin 37 is slidable within tubular member 33 and can be positioned through tab plate 20 as shown in FIGS. 7 and 8, and into aperture 43 located in mullion 12 such that cross bar 19 engages both panel 17 and mullion 12. As shown particularly in FIG. 8, gaskets 27 are compressed against mullion 12 so as to provide a seal. It will be understood that gaskets surrounding the perimeters of panel 16 and 17 likewise are compressed against mullion 13, head member 14 and sill member 15 thus creating a seal against all sides of the window frame.

In use, it is contemplated that in fair weather conditions or conditions otherwise not requiring the shutter system 11 of the invention, panels 16 and 17 can be stored at a central location or locations within the building. In this regard, an advantageous feature of panels 16 and 17 of the invention is that they are conveniently stackable. Particularly, tab plates 20, being rotateably mounted, can be rotated to their flush position to improve the stackability of the panels. When installment of the system is desired, panels 16 and 17 are removed from their central location and taken to window areas along with cross bars 19 with their associated deadbolt pins 37. One of panels 16 and 17 is then positioned appropriately within the window frame nearly flush against window 24. The other of the panels is then also positioned within window frame. At this point, the outer perimeters of panels 16 and 17 which abut mullions 12 and 13 are substantially flush against the window, while the inner perimeters of the panels are slightly removed from the windows. Guide plates 21 and 22 attached to respective panels 16 and 17 overlap the adjacent panel and assist in maintaining vertical alignment of the abutting edges of panels 16 and 17. Pressure is manually applied to the panels near their abutting edges such that the innermost perimeters of the panels 16 and 17 are pushed substantially flush against the window 23. Because panels 16 and 17, together, are slightly oversided with respect to the inner dimensions of the window frame, during this operation, gaskets 27 are compressed against mullions 12 and 13 creating seals. Likewise, gaskets 27 located at the upper and lower edges of panels 16 and 17 are compressed against head member 16 and sill member 15 creating seals therebetween. Of course, abutting edges of panels 16 and 17 are also urged against one another in this pressure fit, thus compressing their respective gaskets against one another and creating a seal and the central joint.

Once panels 16 and 17 are forced substantially flush against window 23, cross bars 19 are manually positioned to align their outermost deadbolt pins 37 with the apertures 43 in the mullions 12 and 13. In so doing,the appropriate notched portions of cross bars 19 will be aligned with tab plates 20 of panels 16 and 17 which are rotated to their horizontally-extending positions and reside within the notches. Deadbolt pins 37 are then moved from their disengaged to their engaged positions as previously discussed so as to extend through tab plates 20 and engage panels 16 and 17 and, in the case of the outermost positioned deadbolt pins 37, to also extend into apertures 43 in mullions 12 and 13 and engage the same. In this manner, the shutter system 11 is pressure fitted into the window frame and is supported against both positive and negative pressures by cross bars 19.

To disassemble shutter system 11, of course, the deadbolt pins 387 are moved to their disengaged positions. Cross bars 19 can then be removed, and panels 16 and 17 can be pulled from their flush positions and appropriately stored pending further use.

It will be well understood that the above-described preferred system is preferred, and that numerous other design features can be incorporated into a shutter system to achieve similar results. For example, instead of or in addition to having apertures 43 in mullions 12 and 13, bracket members can be appropriately affixed to mullions 12 and 13 and/or to panels 16 and 17 which brackets are adapted to receive and engage cross bars. Pins can extend through the brackets and through the engaged cross bars so as to provide protection against both positive and negative pressures. In a similar vein, central joint between panels 16 and 17 can be a hinged arrangement, or can be a knuckle or other satisfactory joint arrangement which facilitates a pressure fit of the panels 16 and 17 within the window frame as discussed hereinabove.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A storm shutter system, comprising:

a window mounted within a window frame and separating a building exterior from a building interior;

a plurality of shutter panels substantially flush against and covering an interior surface of said window, said panels having perimeter edges and compressible members attached about said perimeter edges for creating seals between the shutter panels and the window frame and between perimeter edges of the shutter panels which abut one another;

said panels together further being slightly oversided relative to said window frame such that when said panels are positioned flush against said window, said compressible members are compressed against said window frame thereby creating a seal between said panel members and said window frame and also creating a seal between perimeter edges of said panel members which abut one another;and one or more cross bar members mounted interiorly of said panels so as to support said panels against positive pressure.

2. The storm shutter system of claim 1, wherein said shutter panels comprise an inner core member having a first face for positioning against said window and a second face facing interiorly of the building, and metal sheet covering at least said first face.

3. The storm shutter system of claim 2,wherein said panels comprise metal sheet covering said first and second faces.

4. The storm shutter system of claim 2 wherein said inner core member is formed from plastic.

5. The storm shutter system of claim 4 wherein said inner core member is formed from a honeycomb plastic member.

6. The storm shutter system of claim 4 wherein said panels comprise metal sheet covering said first and second faces.

7. The storm shutter system of claim 6 which includes cross bar-engaging members attached to said panels and located on said second faces, said cross-bar engaging members engaging said cross bars to support said panels.

8. The storm shutter system of claim 7 wherein said cross bars are supported by said window frame.

9. The storm shutter system of claim 8 wherein said window frame defines apertures and said cross bars comprise deadbolt pins extending into said apertures to support said cross bars.

10. The storm shutter system of claim 9 wherein said cross bar-engaging members are movably attached to said panels and are positionable in a first position substantially flush against or interior of said second face of said panel, said positionable in a second position extending outwardly from said second face for engaging said cross bar.

11. The storm shutter system of claim 10 wherein said cross bar-engaging members comprise a plurality of plates each defining an aperture, and said cross bars comprise deadbolt pins slidable into said apertures in said plates.

12. A shutter panel for a storm shutter system, comprising;

an inner core member having first and second faces and perimeter edges, said first face for positioning against a window and said second face for engaging a cross bar;

metal sheet covering at least said first face;

compressible members attached about said perimeter edges;

cross bar-engaging members movably attached to said panel and located on said second face, said cross-bar engaging members being adapted to engage a cross bar for supporting said panel, said cross bar-engaging members further being positionable to a first position substantially flush against or interior of said second face of said panel, and positionable to a second position extending outwardly from said second face for engaging said cross bar.

13. The shutter panel of claim 1, wherein said inner core member is formed from plastic.

14. The shutter panel of claim 13 wherein said panel includes panel frame members affixed to said inner core about said perimeter edges, said panel frame members being adapted to engage and secure said compressible members in position.

15. The shutter panel of claim 14 wherein said panel frame members are formed from extruded aluminum.

16. The shutter panel of claim 15 wherein said sheet metal is aluminum.

17. A storm shutter for installation in the interior frame of a door or window opening, comprising:

a plurality of shutter panels adapted to cover said opening and having perimeter edges and compressible members attached about said perimeter edges for creating seals between the shutter panels and the frame and between perimeter edges of the shutter panels which abut one another;

said panels further being slightly oversized relative to said frame such that when said panels are positioned in said frame to cover said opening, said compressible members are compressed against said frame thereby creating a seal between said panel members and said frame and also creating a seal between perimeter edges of said panel members which abut one another, and one or more cross bar members mounted interiorly of said panels so as to support said panels against positive pressure.

18. The storm shutter of claim 17 wherein said shutter panels have first and second faces, said first face for positioning against a window or door in said opening and said second face for engaging said cross bar.

19. The storm shutter of claim 18 wherein said first and second faces are covered with metal sheet and said panels have attached cross bar-engaging members located on said second faces, said cross-bar engaging members being adapted to engage said cross bar for supporting said panel.

20. The storm shutter of claim 19 wherein said cross bar-engaging members are positionable to a first position substantially flush against or interior of said second faces, and positionable to a second position extending outwardly from said second face for engaging said cross bar.

* * * * *